US009576690B2

(12) United States Patent
Dent, Jr.

(10) Patent No.: US 9,576,690 B2
(45) Date of Patent: Feb. 21, 2017

(54) APPARATUS AND METHODS FOR TRANSMUTATION OF ELEMENTS

(71) Applicant: Dent International Research, Inc., Huntsville, AL (US)

(72) Inventor: William Vaden Dent, Jr., Hampton Cove, AL (US)

(73) Assignee: Dent International Research, Inc., Huntsville, AL (US)

( * ) Notice: Subject to any disclaimer, the term of this patent is extended or adjusted under 35 U.S.C. 154(b) by 570 days.

(21) Appl. No.: 13/918,196

(22) Filed: Jun. 14, 2013

(65) Prior Publication Data

US 2013/0336437 A1 Dec. 19, 2013

Related U.S. Application Data

(60) Provisional application No. 61/660,463, filed on Jun. 15, 2012, provisional application No. 61/824,216, filed on May 16, 2013.

(51) Int. Cl.
*G21G 1/00* (2006.01)
*G21G 1/06* (2006.01)

(52) U.S. Cl.
CPC ..... *G21G 1/001* (2013.01); *G21G 1/06* (2013.01); *G21G 2001/0042* (2013.01)

(58) Field of Classification Search
CPC ... G21G 1/001; G21G 1/06; G21G 2001/0042
See application file for complete search history.

(56) References Cited

U.S. PATENT DOCUMENTS 3,468,808 A 9/1969 Arino
3,519,385 A 7/1970 Hurst et al.
(Continued)

FOREIGN PATENT DOCUMENTS

CA 1113257 A1 12/1981
GB 2487198 A 7/2012
(Continued)

OTHER PUBLICATIONS

Salikhbaev et al. Possibility of Production of Molybdenum-99 Using Neutron Activation at the WWR-SM Research Reactor with LEU Fuel. Oct. 9-13, 2011. Santiago, Chile. 2 pages. <http://www.rertr.anl.gov/RERTR33/pdfs/S12-P9_Salikhbaev.pdf>.*
(Continued)

*Primary Examiner* — Jack W Keith
*Assistant Examiner* — Lily C Garner
(74) *Attorney, Agent, or Firm* — Knobbe, Martens, Olson & Bear, LLP

(57) ABSTRACT

Examples of apparatus and methods for transmutation of an element are disclosed. An apparatus can include a neutron emitter configured to emit neutrons with a neutron output, a neutron moderator configured to reduce the average energy of the neutron output to produce a moderated neutron output, a target configured to absorb neutrons when exposed to the moderated neutron output, the absorption of the neutrons by the target producing a transmuted element, and an extractor configured to extract the desired element. A method can include producing a neutron output, reducing the average energy of the neutron output with a neutron moderator to produce a moderated neutron output, absorbing neutrons from the moderated neutron output with the target to generate a transmuted element, and eluting a solution through the target to extract a desired element. In some examples, the target includes molybdenum-98, and the desired element includes technetium-99m.

14 Claims, 9 Drawing Sheets

(56) References Cited

U.S. PATENT DOCUMENTS

| | | | | |
|---|---|---|---|---|
| 3,664,964 | A * | 5/1972 | Haney | A61K 51/00 210/672 |
| 3,752,769 | A | 8/1973 | Lewis et al. | |
| 5,596,611 | A | 1/1997 | Ball | |
| 5,615,238 | A | 3/1997 | Wiencek et al. | |
| 5,774,782 | A | 6/1998 | Mirzadeh et al. | |
| 5,784,423 | A | 7/1998 | Lidsky et al. | |
| 5,802,438 | A | 9/1998 | Bennett et al. | |
| 5,802,439 | A | 9/1998 | Bennett et al. | |
| 5,949,836 | A | 9/1999 | Lidsky et al. | |
| 6,160,862 | A | 12/2000 | Wiencek et al. | |
| 6,208,704 | B1 | 3/2001 | Lidsky et al. | |
| 6,678,344 | B2 | 1/2004 | O'Leary et al. | |
| 6,870,894 | B2 | 3/2005 | Leung et al. | |
| 6,907,097 | B2 | 6/2005 | Leung | |
| 7,139,349 | B2 | 11/2006 | Leung | |
| 7,362,842 | B2 | 4/2008 | Leung | |
| 7,639,770 | B2 | 12/2009 | Leung | |
| 7,796,720 | B1 | 9/2010 | Rubbia | |
| 7,968,838 | B2 | 6/2011 | Dent | |
| 8,090,072 | B2 | 1/2012 | Rubbia | |
| 8,126,104 | B2 | 2/2012 | Schenter et al. | |
| 8,437,443 | B2 | 5/2013 | Russell, II et al. | |
| 8,450,629 | B2 | 5/2013 | Pitcher | |
| 9,240,253 | B2 | 1/2016 | Varnedoe et al. | |
| 2005/0082469 | A1 | 4/2005 | Carlo | |
| 2006/0023829 | A1 | 2/2006 | Schenter et al. | |
| 2007/0160176 | A1 | 7/2007 | Wada | |
| 2008/0187487 | A1 | 8/2008 | Larsen et al. | |
| 2009/0060812 | A1 | 3/2009 | Schenter et al. | |
| 2010/0215137 | A1 | 8/2010 | Rolston et al. | |
| 2010/0266083 | A1 | 10/2010 | Bloomquist et al. | |
| 2011/0272272 | A1 | 11/2011 | Pitcher | |
| 2012/0069946 | A1* | 3/2012 | Hamill | G21G 1/06 376/182 |
| 2012/0106691 | A1 | 5/2012 | Toth et al. | |
| 2012/0275557 | A1 | 11/2012 | Gentile et al. | |
| 2013/0136221 | A1 | 5/2013 | Nishikata et al. | |
| 2013/0301769 | A1 | 11/2013 | Schaffer et al. | |
| 2014/0029710 | A1 | 1/2014 | Wilson et al. | |

FOREIGN PATENT DOCUMENTS

| | | | |
|---|---|---|---|
| WO | 0180251 | A2 | 10/2001 |
| WO | 2013/188793 | A2 | 12/2013 |

OTHER PUBLICATIONS

Romanovski et al. Development of Rhenium-188 Extraction Generator. St. Petersburg, Russia. 2002. 2 pages. <http://technetium-99.ru/pdf/2615.pdf>.*

International Preliminary Report on Patentability in corresponding International Application No. PCT/US2013/045935, mailed Dec. 24, 2014, 9 pages.

Salikhbaev et al., "Possibility of Production of Molybdenum-99 Using Neutron Activation at the WWR-SM Research Reactor with LEU Fuel", RERTR 2011, 33rd International Meeting on Reduced Enrichment for Research and Test Reactors, Oct. 9-13, 2011, Santiago, Chile, XP002716769, retrieved from the Internet: http://www.rertr.anl.gov/RERTR33/pdfs/S12-P9_Salikhbaev.pdf, retrieved on Nov. 19, 2013, 2 pages.

Romanovski et al., "Development of Rhenium-188 Extraction Generator", Mar. 27, 2002, XP002716770, retrieved from the Internet: http://www.technetium-99.ru/pdf/2615.pdf, retrieved on Nov. 20, 2013, 2 pages.

International Search Report and Written Opinion in corresponding International Application No. PCT/US2013/045935, mailed Dec. 2, 2013, 13 pages.

Yuldashev, et al., "The Lessons Learned From Conversion Of 10 MW Research Reactor To Low Enrichment Fuel," European Research Reactor Conference 2011, Mar. 22, 2011, pp. 4-6.

Committee on Medical Isotope Production Without Highly Enriched Uranium, National Research Council, The National Academy of Sciences, "Medical Isotope Production Without Highly Enriched Uranium", 2009; 221 pages.

Van der Marck, Steven C., Koning, Arjan J., and Charlton, Kevin E., "The Options for the Future Production of the Medical Isotope 99Mo", Jun. 11, 2010; pp. 1817-1820.

J. Celenk et al., "Measurement of Macroscopic and Microscopic Thermal Neutron Cross Sections of V, Co, Cu, In, Dy, and Au Using Neutron-Self Absorption Properties", Journal of Radioanalytical and Nuclear Chemistry, Articles, vol. 148, No. 2, Apr. 1991, pp. 393-401.

J. H. Chen et al., "Cation Self-Diffusion in Chalcopyrite and Pyrite", Metallurgical Transactions B, vol. 6B, Jun. 1975, pp. 331-339.

Herr et al., "Obtaining a Virtually Unsupported Radio-copper Preparation Cu of High Activity of Copper Phthalocyanine", Z. Naturforschg 5a, Nov. 1950, pp. 629-630.

Neutron Temperature, Wikipedia, available from http://en.wikipedia.org/wiki/Neutron_temperature, accessed Aug. 6, 2016.

* cited by examiner

APPARATUS AND METHODS FOR TRANSMUTATION OF ELEMENTS

CROSS-REFERENCE TO RELATED APPLICATIONS

This application claims the benefit of priority under 35 U.S.C. §119(e) to U.S. Patent Application No. 61/660,463, entitled "VESSEL FOR TRANSMUTATION OF ELEMENTS," filed Jun. 15, 2012, and to U.S. Patent Application No. 61/824,216, entitled "VESSEL FOR TRANSMUTATION OF ELEMENTS," filed May 16, 2013; each of the foregoing applications is hereby incorporated by reference herein in its entirety.

BACKGROUND

Field

The present disclosure relates generally to apparatus and methods for transmutation of elements, and in particular, to apparatus and methods for the transmutation of molybdenum-98 to generate technetium-99m.

Description of the Related Art

Technetium-99m (Tc-99m) is a workhorse isotope in nuclear medicine and is widely used in diagnostic medical imaging. Tc-99m is typically used to detect disease and study organ structure and function. Technetium-99m is a metastable nuclear isomer of technetium-99 (Tc-99) with a half-life of 6 hours and emits 140 keV gamma ray photons when it decays to technetium-99. The gamma rays can be used for medical imaging. The U.S. supply of Tc-99m is generally produced by irradiating highly enriched uranium (HEU) in a reactor, extracting the fission product molybdenum-99 (Mo-99) from the HEU targets, and collecting Tc-99m that is produced when Mo-99 spontaneously beta decays with a half-life of 66 hours.

SUMMARY

Apparatus and methods for the transmutation of elements are provided.

In some embodiments, an apparatus for the generation of technetium-99m from molybdenum-98 comprises a neutron generator configured to emit neutrons with a neutron output, a neutron moderator having a diameter $D_1$ and configured to reduce an average energy of the neutron output to produce a moderated neutron output, one or more sections having a diameter $D_2$ and comprising molybdenum-containing material configured to absorb neutrons when exposed to the moderated neutron output, the absorption of the neutrons by the molybdenum-containing material producing molybdenum-99 from molybdenum-98, and an extractor configured to extract technetium-99m from the one or more sections.

In some variations, an apparatus for transmutation of an element comprises a neutron emitter configured to emit neutrons with a neutron output, a neutron moderator configured to reduce an average energy of the neutron output to produce a moderated neutron output, a target configured to absorb neutrons when exposed to the moderated neutron output, the absorption of the neutrons by the target producing a transmuted element, and an extractor configured to extract a desired element.

Methods of transmutating a target are also provided. In some embodiments, a method of transmutating a target comprises producing a neutron output, reducing an average energy of the neutron output with a neutron moderator to produce a moderated neutron output, absorbing neutrons from the moderated neutron output with the target to generate a transmuted element, and extracting a desired element.

BRIEF DESCRIPTION OF THE DRAWINGS

The foregoing and other features of the present disclosure will become more fully apparent from the following description and appended claims, taken in conjunction with the accompanying drawings.

Like reference numbers and designations in the various drawings indicate like elements unless the context dictates otherwise.

DETAILED DESCRIPTION

Overview

The present disclosure describes examples of apparatuses and methods for the production of nuclear isotopes or elements by the nuclear transmutation process of neutron absorption and forming a new nuclide. The physical principles of creating isotopes or elements by the process of an element absorbing a neutron and transmuting to a different element or isotope are well understood. In some embodiments, the disclosed apparatuses and methods produce sufficient quantities of isotopes or elements for their application in medicine, industry, research, or other fields requiring nuclear materials.

In many of the following examples, transmutation of molybdenum 98 (Mo-98) by absorption of a neutron to form Mo-99 will be described. However, the apparatus and methods described herein are not limited to this reaction and have applicability to a broad range of neutron transmutation reactions. Mo-99 can be produced from Mo-98 by the following neutron reaction:

$$\text{Mo-98+neutron} \rightarrow \text{Mo-99} \rightarrow \text{Tc-99}m$$

The Mo-99 decays by beta decay to produce Tc-99m, which is the most widely used radioactive tracer isotope for medical diagnostic imaging. The Tc-99m is metastable and decays (with a half-life of about 6 hours) by emission of a gamma ray to Tc-99. The energy of the gamma ray is 140 keV (with 1 eV≈$1.6\times10^{-19}$ J) and is very useful for medical imaging.

Since the half-life of Mo-99 is about 66 hours, it cannot be stored and used to produce Tc-99m on demand, and thus it must be replenished. The apparatus and methods described herein advantageously can be used to produce Mo-99, and the Tc-99m decay product can be collected for desired uses, such as in medical diagnostic imaging.

Examples of Apparatus for Neutron Transmutation

Figure 1:
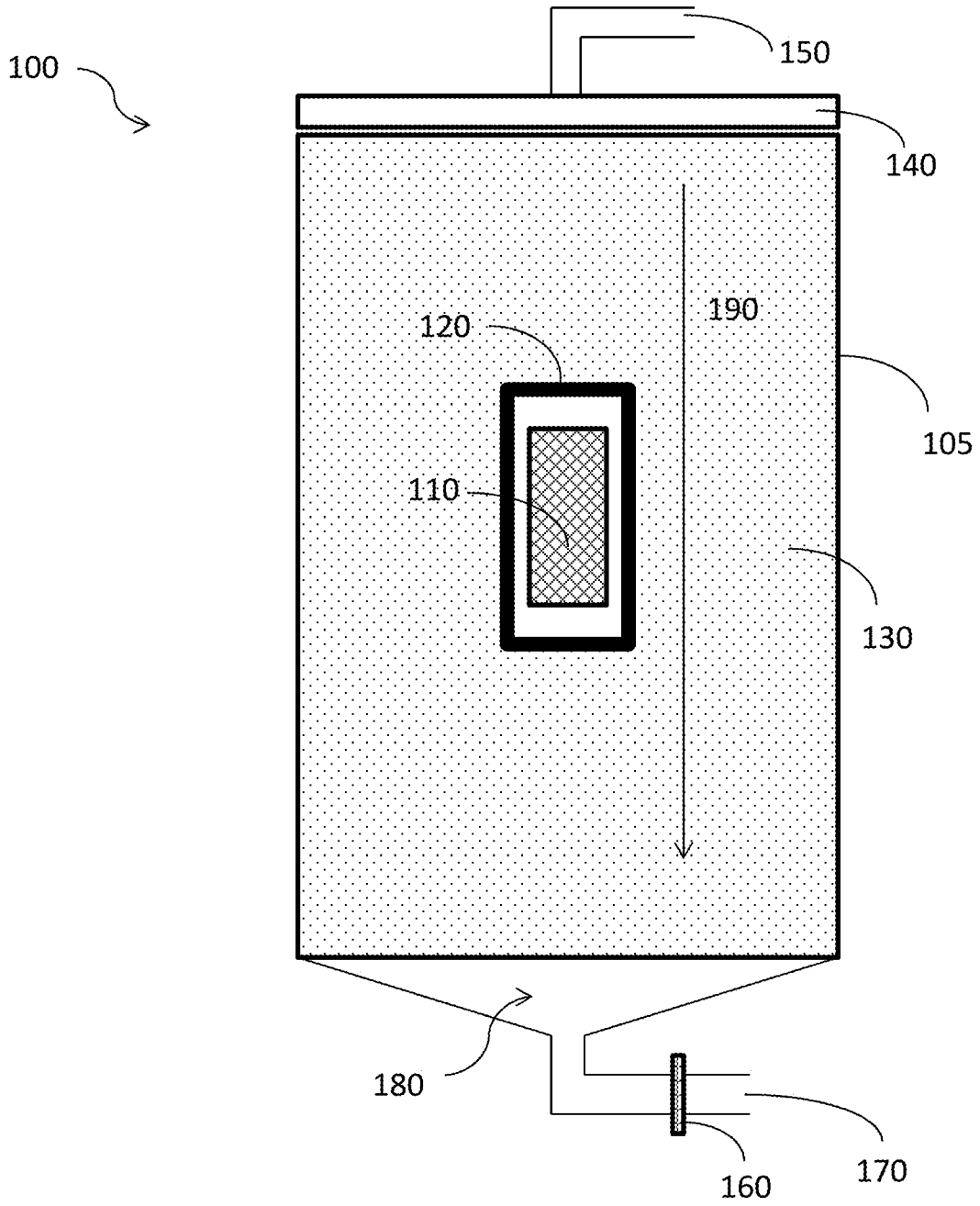
FIG. 1 is cross-section view of an example of an apparatus for transmuting elements.

One embodiment of the disclosed apparatus is shown in FIG. 1. The apparatus 100 can be in any shape, including but not limited to cylindrical, spherical, square, or rectangular. The apparatus may be built in sections to allow access to the inner regions of the apparatus. In some embodiments, the apparatus 100 may comprise a neutron emitter configured to emit neutrons with a neutron output, a neutron moderator configured to reduce the average energy of the neutron output to produce a moderated neutron output, a target configured to absorb neutrons when exposed to the moderated neutron output, the absorption of the neutrons by the target producing a transmuted element, and an extractor configured to extract a desired element. The apparatus 100 comprises a housing 105 made of aluminum, steel, beryllium, or any other material capable of holding material which holds the element material to be transmuted inside it.

In some embodiments, the neutron emitter may comprise a neutron generator 110. The neutron generator may be disposed in various positions. For example, the neutron generator may be disposed outside the apparatus and configured to inject neutrons into the apparatus. In such embodiments, the neutron generator may be positioned adjacent to the apparatus or within sufficient proximity to the apparatus such that sufficient neutrons are generated to carry out the desired transmutation. Such an external configuration may be advantageous when used with neutron generators that produce an anisotropic distribution of neutrons (e.g., a beam of neutrons that can be injected into the apparatus). In other embodiments, a plurality of neutron generators can be used.

In some variations, the neutron generator may be located anywhere within the apparatus itself, such as in the upper portion of the apparatus, the lower portion of the apparatus, or towards the left or right portion of the apparatus. In some embodiments, the neutron generator 110 is located in the central region of the apparatus as depicted in FIG. 1.

The neutron generator produces neutrons, for example, by accelerating deuterium (D) and/or tritium (T) nuclei into a target containing deuterium and/or tritium. Neutrons may be produced by other methods, such as accelerating deuterons into boron (e.g., $^{10}B$) or by other means of producing neutrons. The neutron generator may produce neutrons continuously or pulsed at a rate in a range of about $1\times10^{10}$ to $1\times10^{15}$ neutrons per second in various implementations. The neutron generator may be of any shape, including but not limited to cylindrical, spherical, square, rectangular, or any shape of rough dimensions of about 20 to about 60 centimeters in height by about 20 to about 60 centimeters in width by about 20 to about 60 centimeters in depth, in some implementations.

In some embodiments, the size of the inner central region of the apparatus may be determined by the size of a neutron generator located in the central region of the apparatus. Additional volume may be included to accommodate high voltage input cables and water cooling tubes which attach to the neutron generator.

The neutron generator may be a non-fissile device that does not produce neutrons from the fission of heavy elements (such as uranium) or produce neutrons that are capable of sustaining a chain reaction of nuclear fission. Thus, the neutron generator, in some embodiments, is not a nuclear fission reactor. The neutron generator can be a neutron tube in some embodiments. Another example of a neutron generator usable with any of the embodiments described herein is the cylindrical neutron generator disclosed in U.S. Pat. No. 6,907,097, which is hereby incorporated by reference in its entirety. Another example of a neutron generator usable with any of the embodiments described herein is the cylindrical neutron generator disclosed in U.S. Pat. No. 7,639,770, which is hereby incorporated by reference in its entirety. Other examples of neutron generators usable with embodiments of the apparatus and processes described herein include the neutron generators produced by Adelphi Technology, Inc. (Redwood City, Calif.).

In various embodiments, the number of neutrons per second produced by the neutron generator may be greater than $1\times10^{11}$, $2\times10^{11}$, $3\times10^{11}$, $5\times10^{11}$, $8\times10^{11}$, $1\times10^{12}$, $1\times10^{13}$, $1\times10^{14}$, $1\times10^{15}$ or more. The number of neutrons per second may be in a range from $1\times10^{11}$ to $1\times10^{15}$, in some embodiments. The energy of the neutrons emitted by the neutron generator may be a few MeV (e.g., 2.4 MeV for D-D generators) up to about 14 MeV (e.g., for D-T generators).

In some embodiments, the neutron generator may be surrounded by a neutron moderator 120. In some variations, the neutron moderator 120 immediately surrounds the neutron generator as shown in FIG. 1. The neutron moderator may be configured to reduce an average energy of the neutron output to produce a moderated neutron output. In some embodiments, the neutron moderator 120 may serve as a neutron multiplier to increase the number of neutrons in the apparatus by the nuclear reaction described by nuclear reactions including (n,2n), (n,3n), (n,fission), etc. In some embodiments, the neutron moderator may substantially encompass the neutron generator to efficiently multiply and moderate neutrons. In some embodiments, the neutron moderator may be lead, bismuth, tungsten, thorium, uranium, or any other material which produces neutrons when struck by neutrons. The neutron moderator may be depleted uranium. In some embodiments, the neutron moderator may be water, deuterium oxide, beryllium, carbon (e.g. graphite, density=2.267 g/cm$^3$), polyethylene (density=0.92 gm/cm$^3$), or combinations thereof. In some embodiments, the neutron moderator is optional and may not be used in other embodiments.

The thickness of the neutron moderator may vary. In some embodiments, the thickness of the neutron moderator may be sufficient to reduce the energy of the neutron output to a level where the neutron capture cross-section of the target is above a first threshold. In some embodiments, the neutron moderator has sufficient thickness such that it can reduce the energy of the neutron output to where the cross-section is above a first threshold of about 1% to about 10% or greater of peak cross-section (see example shown in FIG. 6).

In some embodiments, the thickness of the neutron moderator may be less than about 1 cm. In some embodiments, the thickness of the neutron moderator may be about 15 cm. In some embodiments, the thickness of the neutron moderator may range from about 0.1 cm to about 40 cm, about 1 cm to about 20 cm, about 1 cm to about 15 cm, or about 5 cm to about 10 cm.

The apparatus may also comprise a target 130 configured to absorb neutrons when exposed to the moderated neutron output, the absorption of the neutrons by the target producing a transmuted element. In some embodiments, the neutron moderator 120 may be surrounded by the target 130 as shown in FIG. 1. The target 130 may include the element to be transmuted in atomic and/or molecular form. In some embodiments, the target 130 may also include elements that may serve to further moderate the high energy neutrons down to energy levels where the neutrons are efficiently absorbed in the element to be transmuted. The target may comprise at least one of calcium, carbon, chromium, cobalt, erbium, fluorine, gallium, tritium, indium, iodine, iron, krypton, molybdenum, nitrogen, oxygen, phosphorus, rubidium, samarium, selenium, sodium, strontium, technetium, thallium, xenon, yttrium, or any other element capable of producing an element or isotope by neutron transmutation. The target may also include at least one of the element or elements which produce the following elements when irradiated by neutrons: calcium, carbon, chromium, cobalt, erbium, fluorine, gallium, tritium, indium, iodine, iron, krypton, molybdenum, nitrogen, oxygen, phosphorus, rubidium, samarium, selenium, sodium, strontium, technetium, thallium, xenon, or yttrium.

In some embodiments, the thickness of the target may be sufficient to reduce the energy of the moderated neutron output to a level where the neutron capture cross-section of the target is above a second threshold, the second threshold above the first threshold. In some embodiments, the second threshold may be near a peak of the neutron capture cross-section of the target (e.g., about 300 to about 500 eV, see example shown in FIG. 6).

In some embodiments, the apparatus may also comprise additional moderator material. The additional moderator material may be any element or compound that may moderate the neutrons and/or assist in the extraction of the transmuted element from the apparatus. The additional moderator material may be carbon, aluminum oxide, magnesium oxide, molybdenum dioxide, molybdenum trioxide, or a combination thereof. In some embodiments, the additional moderator material may be powder form of molybdenum metal, molybdenum dioxide, molybdenum trioxide, aluminum oxide, carbon, beryllium, deuterium oxide, water, other metal oxides, or a combination thereof. In some embodiments, the apparatus may include molybdenum metal that may be coated to the exterior of grains of aluminum oxide. In some embodiments, molybdenum trioxide is not used since it may be soluble in certain eluting solutions.

In some embodiments, the additional moderator material may partially fill, (for example, less than 50% by volume) or substantially fill (for example, greater than 50% by volume) the volume of the apparatus surrounding the neutron moderator (or the neutron generator if a neutron moderator is not used). In some embodiments, the additional moderator material may form a mixture with the target. In such embodiments, the neutron moderator 120 may be substantially surrounded by the mixture.

In some embodiments, the thickness of the target itself, the mixture of the target and the additional moderator material, or the additional moderator material itself may be less than about 100 cm. In some embodiments, the range of the thickness of the target itself, the mixture of the target and the additional moderator material, or the additional moderator material itself may be about 1 cm to about 150 cm, about 20 cm to about 130 cm, or about 50 cm to about 100 cm.

In some embodiments, the disclosed apparatuses may include an extractor 180 configured to extract a desired element. In some variations, the extractor may be a chromatography system, a vacuum filtration system, a centrifuge system, a vacuum evaporation system, gravity filtration system, or a combination thereof. In some embodiments, the extractor may include, for example, pumps, reservoirs, control systems, filters, centrifuges, and the like. The extractor may be in operation while the neutron generator is in operation or not in operation. In some embodiments, the extractor may be located at various positions, such as at the top of the apparatus, sides of the apparatus, bottom of the apparatus, or a combination thereof.

The extractor may also include an eluting solution. In some embodiments, the eluting solution may be water, saline solution, or other solvent capable of extracting the desired element. The eluting solution may be sterile. In some embodiments, the eluting solution may be housed in a reservoir. In some embodiments, the reservoir may be located within the apparatus or external to the apparatus.

In some embodiments, the eluting solution can be configured to enter the apparatus at any position, such as through the top of the apparatus, the bottom of the apparatus, or the sides of the apparatus. The eluting solution may flow through the apparatus under gravity or be pumped under pressure. In other embodiments, suction may additionally or alternatively be applied to assist the flow of the eluting solution through the apparatus. In some embodiments, the eluting solution can be configured to exit the apparatus at any position, such as through the top of the apparatus, the bottom of the apparatus, or the sides of the apparatus. In some embodiments, the eluting solution can be configured to enter and exit the apparatus at different positions. In some embodiments, the eluting solution can be configured to enter and exit the apparatus at substantially the same positions, such as having an inlet and outlet adjacent to each other.

FIG. 1 shows a non-limiting example of extractor 180 and the eluting solution entering the top of the apparatus from an inlet 150 and being spread by a manifold 140 over the top of the apparatus 100. The eluting solution may be spread over some portion of the top of the apparatus, a substantial portion of the top of the apparatus, or the entire top of the apparatus. Spreading the eluting solution over a substantial portion of the top of the apparatus or the entire top of the apparatus may help ensure that the eluting solution passes substantially through the entire volume of the apparatus. The flow of the eluting solution may be down through the apparatus as indicated by arrow 190 in FIG. 1. In some embodiments, the extractor may improve the efficiency or yield of the desired element.

As shown in FIG. 1, the eluting solution may exit the apparatus 100 through an outlet 170. In some embodiments, the eluting solution exiting the apparatus may include the desired element.

In some embodiments, the desired element may be extracted and/or concentrated by vacuum evaporation, by chromatography, by settling, and the like. In some embodiments, the desired element may be extracted and/or concentrated by an extractor that includes a filter 160 as shown in FIG. 1. Examples of filters usable with embodiments of the apparatus may be available from EMD Millipore Corporation (Billerica, Mass.).

After the desired element is extracted, some or all of the eluting solution can be recirculated through the apparatus, which may improve efficiency and reduce waste of the eluting solution. For example, a pump system (not shown in FIG. 1) can be used to pump some or all of the eluting solution (e.g., the eluent) back to the top of the apparatus for re-use.

The apparatus may also be surrounded by a neutron absorbing material (e.g., shielding) to protect people in the vicinity of the apparatus from neutrons not absorbed by materials in the apparatus.

In some embodiments, some or all of the apparatus may be heated (e.g., to more than 100 Celsius), which may assist sterilization of the eluting solution. In some embodiments, one or more bacterial monitoring devices can be used to detect whether the eluting solution (and/or the eluate) has become contaminated.

The overall size of the apparatus, including the neutron generator, neutron moderator, target, radiation safety shielding, housing, high voltage inputs, water cooling tubes, and other ancillary equipment and attachments, if cylindrical in shape, may be from about 1 to about 2 meters in diameter and about 1.5 to about 2.5 meters tall. If spherical in shape, the apparatus may about 1 to about 2.5 meters in diameter.

Figure 2:
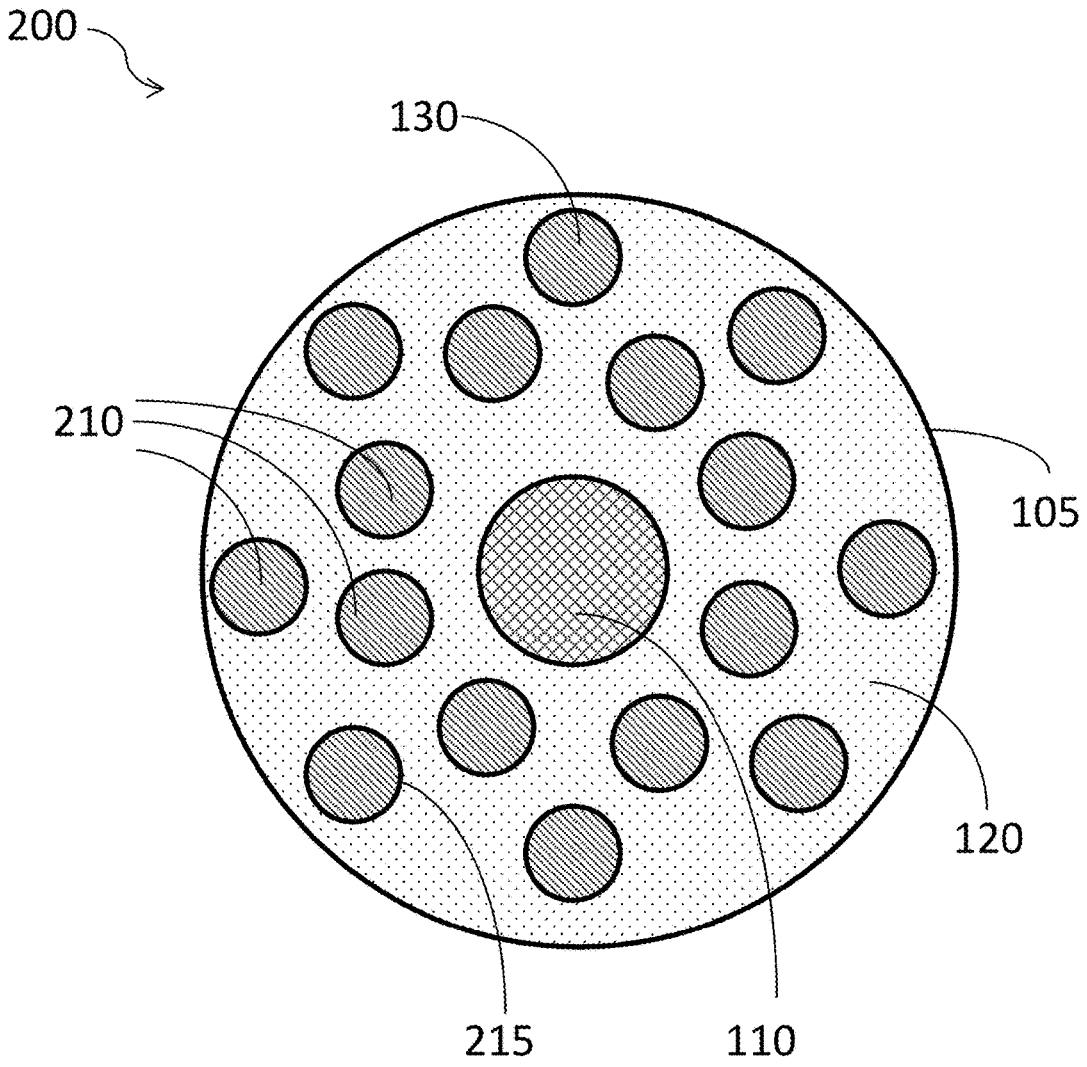
FIG. 2 is a top view of another example of an apparatus for transmuting elements.

Another embodiment of the apparatus is shown in FIG. 2. FIG. 2 depicts a top view of the apparatus 210 taken through a plane through the center of the apparatus. In this embodiment, the target 130 (for example, powdered molybdenum or molybdenum oxide) can be contained in individual tubes 210. A neutron moderator 120, such as carbon, polyethylene, beryllium, deuterium oxide, water, or other such neutron moderator, fills the voids between the tubes. The neutron moderator may serve to slow the neutrons to an energy where they may be efficiently captured by the target.

The tubes 210 may be made from a metal-containing material 215, including but not limited to aluminum, steel, beryllium, or any other material capable of holding material which holds the element material to be transmuted inside it. The tubes may also be in any shape, such as circular, square, rectangular, and the like. In some embodiments, the tubes may have the same shape or different shapes. In some embodiments, the tubes may range from about 1 cm to about 20 cm in diameter and may be substantially about the same length as the apparatus. The tubes may have differing diameters and may have differing lengths. The number of tubes may depend on the size and placement of the tubes to efficiently capture the neutrons; for example, the number of tubes may range from less than 10 to more than 100. The tubes can be surrounded by a neutron moderator, such as water, deuterium oxide, beryllium, carbon, polyethylene, or combinations thereof.

Rather than eluting substantially the entire apparatus at one time (e.g., as described above for the embodiment shown in FIG. 1), each individual tube may be eluted separately. This allows a smaller quantity of the desired element (for example, Tc-99m) to be eluted at one time. Some or all tubes may be eluted simultaneously if desired. The number of the tubes, their positions, their shapes, and their orientations in the apparatus may be different than shown in FIG. 2. For example, the eluting solution may be passed through some or all of the tubes and not passed through a neutron moderator surrounding the neutron generator. In some cases, a sufficient number of tubes may be used so that substantially all the neutrons from the neutron generator are absorbed by the neutron moderator and/or the target before the wall of the apparatus is reached. In some embodiments, the elution process (e.g. wherein the eluting solution can be eluted through the apparatus) may take place while the neutron generator is in operation or not in operation. If the neutron generator remains in operation during the elution process, the remaining tubes may continue to increase in activation (e.g., additional transmuted elements are produced).

Figure 3:
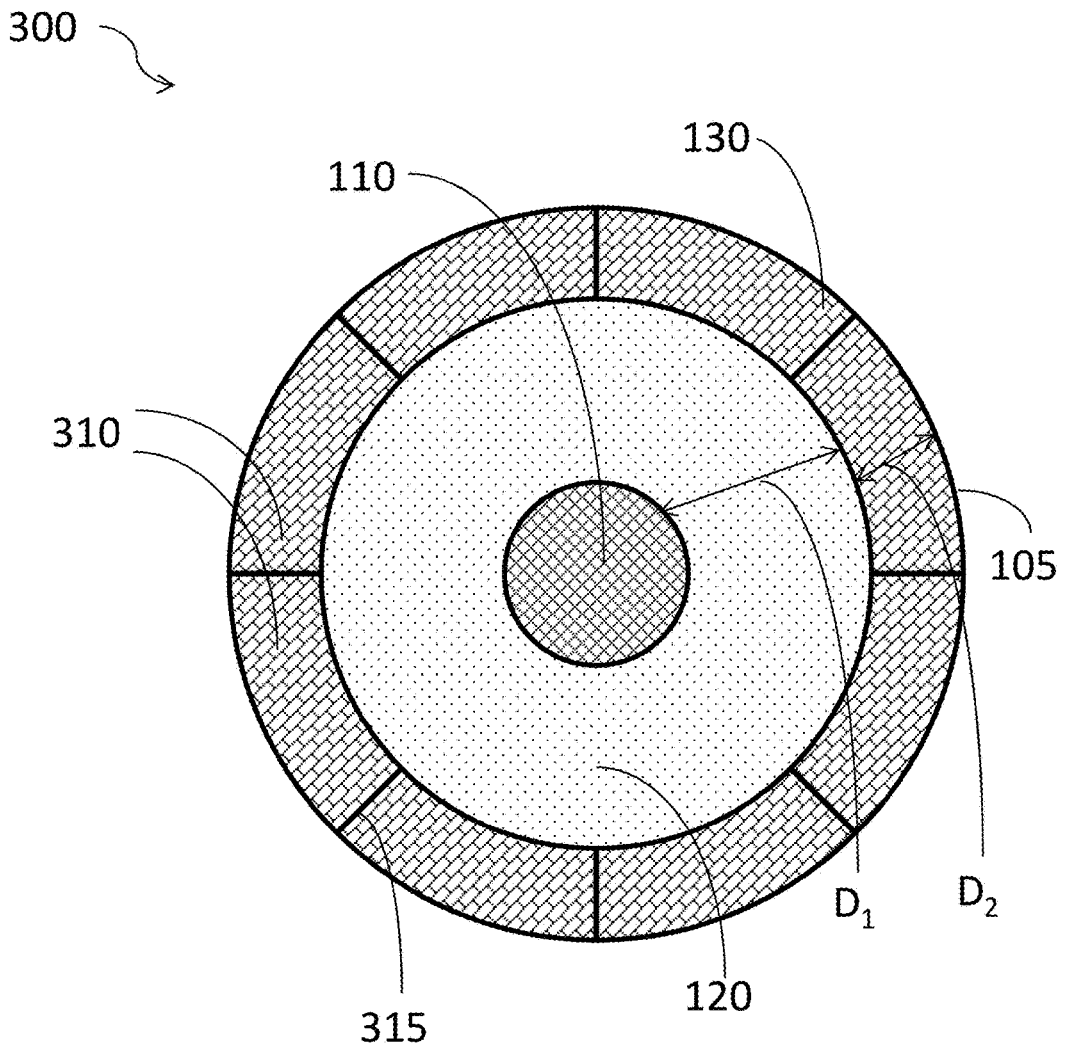
FIG. 3 is a top view of another example of an apparatus for transmuting elements.

Another embodiment of the apparatus 300 is shown in FIG. 3, which depicts a top view of the apparatus taken through a plane through the central of the apparatus. In some embodiments, the neutron generator 110 may be in the center region and surrounded by neutron moderator 120 (including but not limited to carbon, polyethylene, beryllium, deuterium oxide, water, or other neutron moderating material). The neutrons pass from the neutron generator 110, through the moderator material 120, and into the target 130 (such as molybdenum oxide or powdered molybdenum). The target 130 may be a single region or may be partitioned into sections 310. The number of sections could range from less than 10 to more than 100, depending on the desired quantity of element to be transmuted and eluted. The number of sections, their positions, their shapes, and their orientations in the apparatus may be different than shown in FIG. 3. The sections 310 may be partitioned with a metal-containing material 315, including but not limited to aluminum, steel, beryllium, or any other material capable of holding material which holds the element material to be transmuted inside it.

The radial thickness of the sections 310 may range from about 1 centimeter to more than about 20 centimeters, depending on the quantity and density of the material inside each of the sections. One factor that may be used to determine the radial thickness of each of the sections is that it be of such a thickness that it allows for efficient absorption of the neutrons in the target to be transmuted as they pass out of the neutron moderator and through the section.

Figure 6:
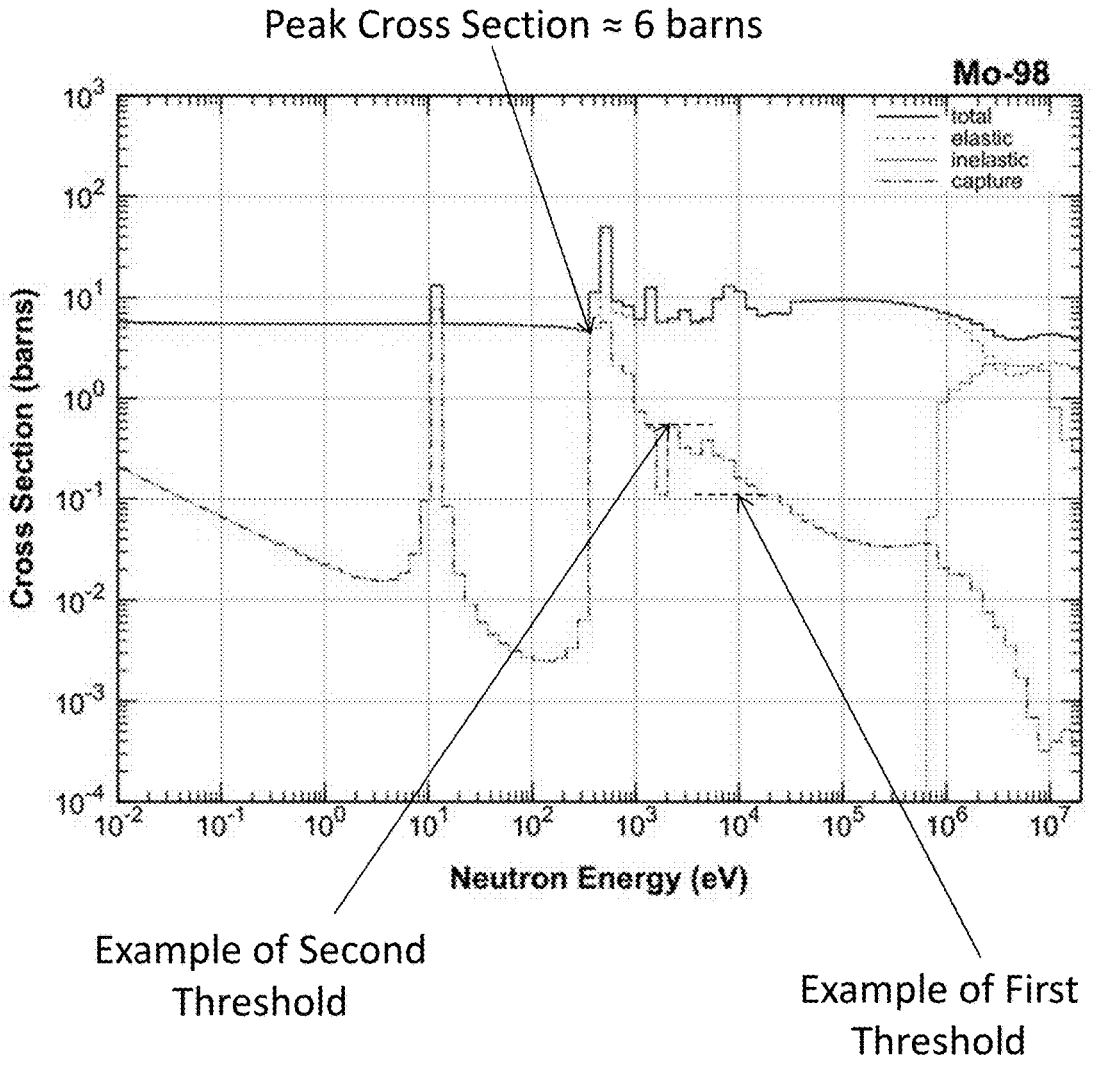
FIG. 6 is a graph of cross section (in barns, with 1 barn=$10^{-28}$ $m^2$) as a function of neutron energy (in eV, with 1 eV≈$1.6\times10^{-19}$ J) for neutron reactions with Mo-98. The long dotted line is for elastic scattering, the short dotted line is for inelastic scattering, the dot-dashed line is for capture, and the solid line is for total cross section.

For example, the neutron absorption cross section for an element such as molybdenum-98 begins to significantly increase starting at a neutron energy of approximately 800 keV with a neutron absorption cross section of about 30 millibarns. FIG. 6 is a graph of cross section (in barns, with 1 barn=$10^{-28}$ $m^2$) as a function of neutron energy (in eV, with 1 eV≈$1.6\times10^{-19}$ J) for neutron reactions with Mo-98. The long dotted line is for elastic scattering, the short dotted line is for inelastic scattering, the dot-dashed line is for capture, and the solid line is for total cross section. The capture peak for molybdenum is at about 400 eV. In some implementations, the thickness of the neutron moderator between the neutron generator and the sections containing the material to be transmuted may be determined by the thickness needed to moderate the neutrons to this energy level of about 800 keV. Depending on the type of moderator used, this thickness could range from approximately 2 centimeters to more than 40 centimeters. The absorption cross section continues to rise to a peak of about 6 barns at a neutron energy of approximately 500 eV. At a neutron energy of approximately 320 eV, the absorption cross section drops sharply to less than 10 millibarns. At this point, the neutrons may no longer efficiently be captured and the material to be transmuted may no longer be needed. This point marks the end of the radius of the absorption section. Depending on the type and density of the target, the thickness of the sections could range from approximately 2 centimeters to about 40 centimeters.

The region or each individual section, or some combination thereof, may be eluted as needed by passing an eluting solution through each of the sections. For example, the eluting solution may be passed through some or all of the sections and not passed through the neutron moderator 120 surrounding the neutron generator 110. In some cases, a sufficient number of sections may be used so that substantially all the neutrons from the neutron generator are absorbed by the neutron moderator and/or the material in the sections before the wall of the apparatus is reached. In some embodiments, the diameter of neutron moderator $D_1$ (between the neutron generator and the sections containing the element to be transmuted) may be selected so that the energy of the neutrons at the sections has been moderated to a value where the element to be transmuted has a sufficiently high cross-section (e.g., greater than about 1% to about 10% of the peak cross section). The diameter of the sections $D_2$ (between the neutron moderator 120 to the housing 105) can be selected so that the neutrons in the sections have been moderated to energies near the peak of the cross-section. For example, for a molybdenum 98 target, the moderator thickness may be selected so that the neutron energies are in a range from about 1 keV to about 100 keV (e.g., 30 to 40 keV) and the thickness of the sections can be sufficient to moderate the neutrons to energies of 100 to 1000 eV (e.g., from 200-600 eV). Selection of the properties of the moderator and target to achieve such objectives can improve the efficiency and/or yield of the transmutation apparatus.

Figure 4A:
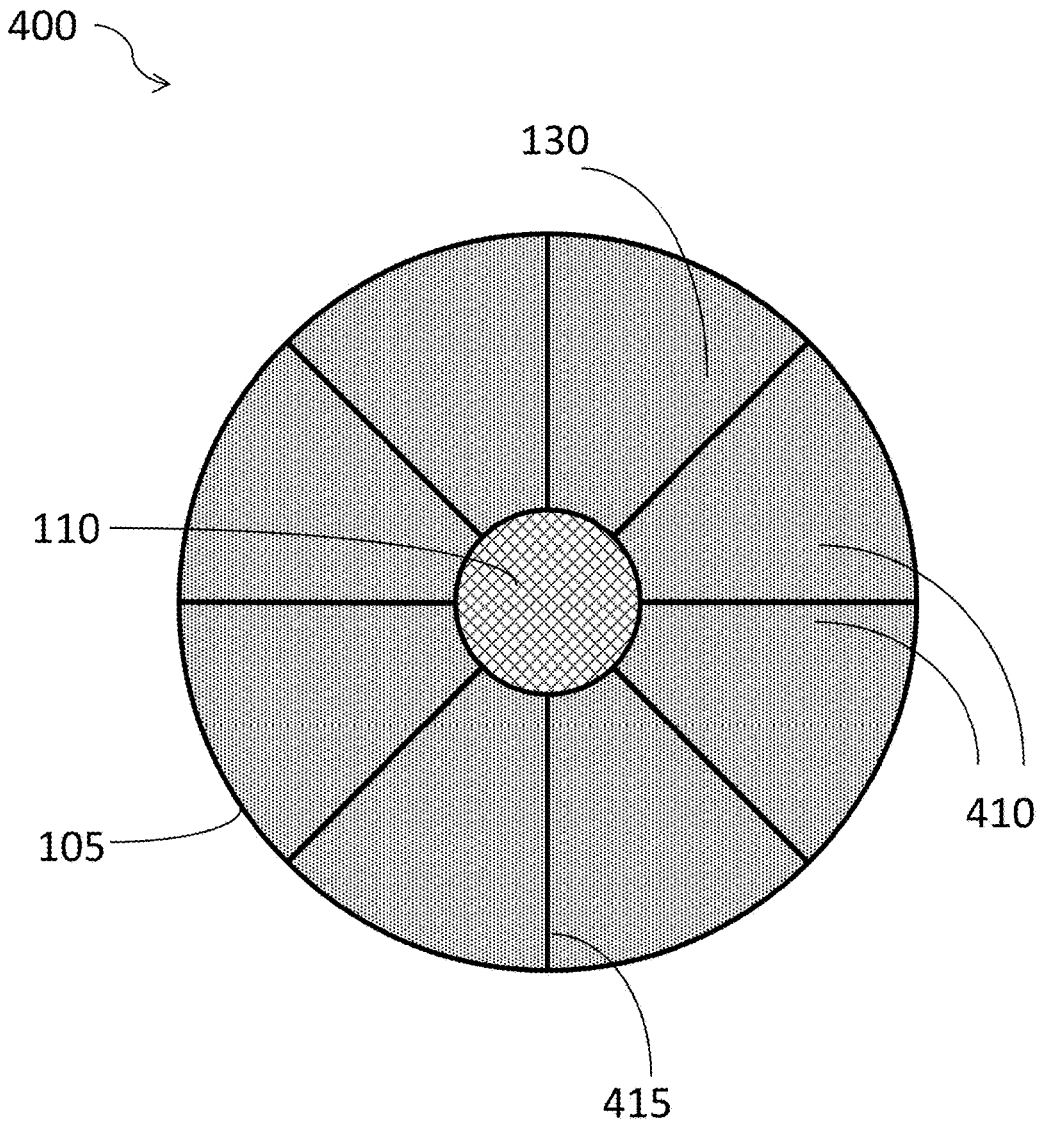
FIG. 4A is a top view and FIG. 4B is a side cross-section view of another example of an apparatus for transmuting elements.
Figure 4B:
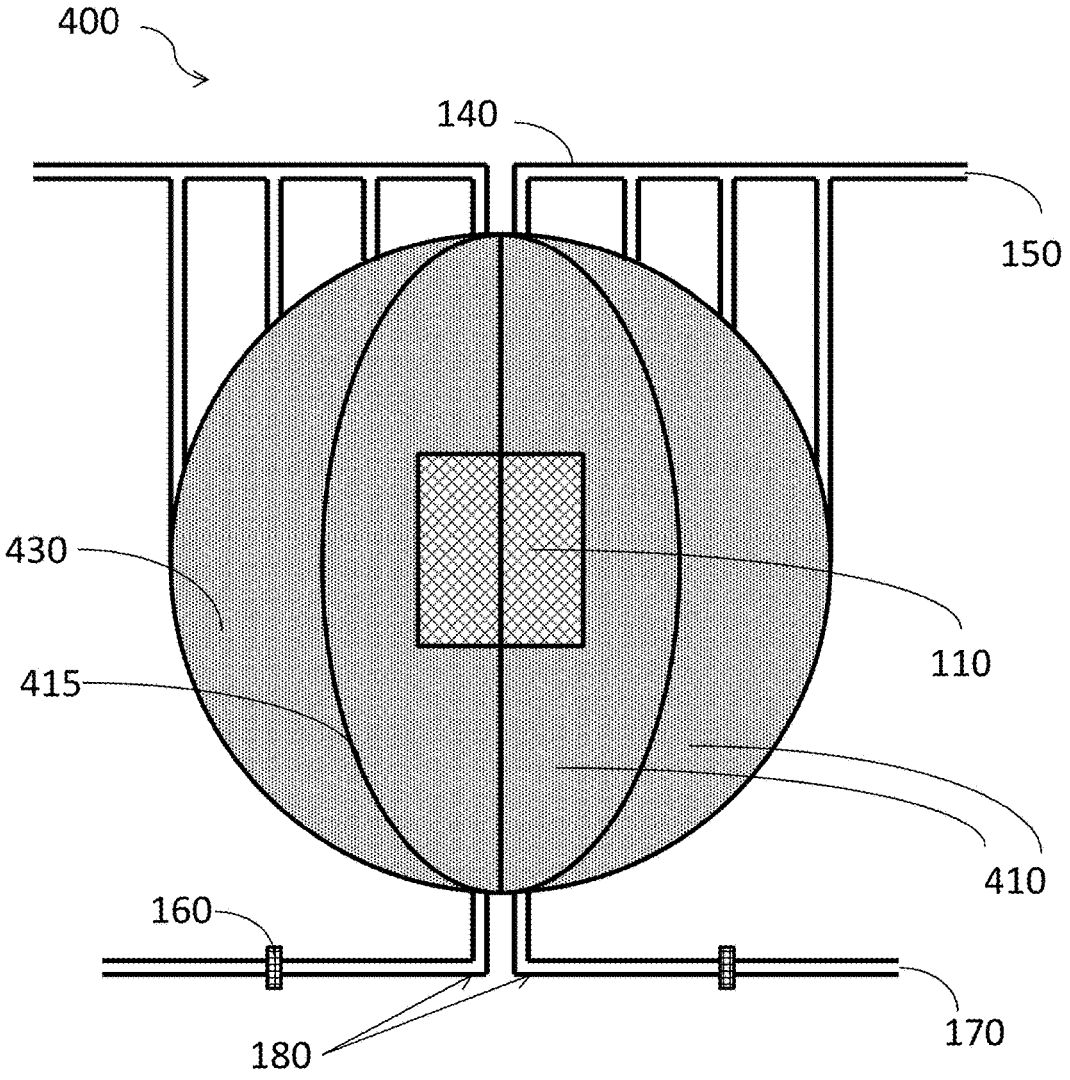

Another embodiment of the apparatus is shown in FIGS. 4A and 4B. FIG. 4A is a top view of the apparatus 400 and FIG. 4B is a side view of the apparatus 400. In this embodiment, the apparatus 400 is roughly spherical in shape with a diameter of between about 0.75 to about 2 meters. The neutron generator 110 may be located in the central region surrounded by sections 410. The sections 410 can include a mixture 430 of the target (for example, powdered molybdenum or molybdenum oxide) and neutron moderator. In some embodiments, the target and neutron moderator may be the same, such as molybdenum dioxide serving as the target (e.g. Mo-98) and neutron moderator. The sections 410 may be a housed in a metal-containing material 415, including but not limited to aluminum, steel, beryllium, or any other material capable of holding material which holds the element material to be transmuted inside it. The number of sections could range from two to many, such as 6, 8, 10, 20, 50 or more. Neutrons produced by the neutron generator propagate into the molybdenum dioxide and are moderated. No additional neutron multiplier material or moderator material is utilized in the embodiment shown in FIGS. 4A and 4B; however, such multiplier or moderator material could be used in other implementations.

As shown in FIG. 4B, the apparatus 400 has a manifold 140 attached to the top of each section 410. This manifold provides an eluting solution to each section 410 to extract the desired element or elements. The eluting solution may enter the apparatus 400 through inlet 150 and may flow down through apparatus 400 to the extractor 180. As a non-limiting example, if the element to be transmuted is molybdenum-98, the element produced is molybdenum-99. In approximately 66 hours, one half of the molybdenum-99 decays to technetium-99. If the elution solution is saline solution, the saline solution reacts with the technetium to form sodium pertechnetate, which may then be eluted from the apparatus (e.g. from the bottom of the apparatus as shown in FIG. 4B). The eluting solution may exit the apparatus 400 through outlet 170. In some embodiments, the eluting solution may include the desired element or elements.

A quantity of eluting solution can be utilized to efficiently remove the sodium pertechnetate from the apparatus. To increase the concentration of sodium pertechnetate in the solution, a filter 160, such as a diafiltration filter, may be placed in the extractor 180 of the apparatus 400. Once the apparatus has been sufficiently eluted, the filter 160 can be back-washed to remove the sodium pertechnetate and produce a more concentrated solution. Additional methods of concentrating the sodium pertechnetate in the solution include vacuum and thermal evaporation. In some embodiments, multiple methods of concentrating the sodium pertechnetate may be used in combination.

Neutrons absorbed by the molybdenum-98 can be useful to produce the desired molybdenum-99. Neutrons absorbed by oxygen (or other elements) and other isotopes of molybdenum do not produce Mo-99 and can constitute a loss factor, which may lower the overall efficiency of molybdenum-99 production. However, without being bound to a particular theory, since the absorption cross-section for neutrons in oxygen-16 is low compared to the neutron absorption cross section for molybdenum-98, oxygen absorbs a small fraction of the neutrons compared to molybdenum-98.

As discussed above, aluminum may be used as housing or to separate sections or tubes in the disclosed apparatus. The housing or metal-containing material used to separate sections or tubes may absorb neutrons in like fashion to the neutron moderator and target, the housing or metal-containing material can have a relatively low neutron absorption cross section. As an example, for aluminum-27 (Al-27), the capture cross sections in the 1 MeV region down to a few hundred eV are in the range of $1\times10^{-3}$ barn, which is well below the cross sections for molybdenum-98. Accordingly, Al-27 can be used as housing or metal-containing material used to separate sections or tubes.

One neutron loss mechanism in the apparatus may be neutron absorption by isotopes of molybdenum other than molybdenum-98. The rate at which isotopes of an element absorb neutrons is proportional to the isotopic percentage composition of the element multiplied by the neutron absorption cross section as a function of energy. A table of an example of molybdenum isotope percentage and two selected neutron absorption cross sections is shown in Table 1. The first column displays the molybdenum isotope. Columns two and three list the approximate neutron absorption cross sections in barns for each isotope at 10 keV and 1 keV. Column four lists the approximate isotopic percentage for each isotope for naturally occurring molybdenum. Column five is the weighted fractional absorption of neutrons for each of the elements at the selected energy levels. Column six is the percentage absorption of neutrons for each isotope. As can be seen from Table 1, in this example, the molybdenum-98 isotope, which may be the desired element to be transmuted, absorbs approximately 27.7% of the total neutrons absorbed by the molybdenum. Thus, approximately 72.3% of the neutrons absorbed by the molybdenum are absorbed by isotopes other than the desired isotope. This loss mechanism can be compensated for by increasing the output of the neutron generator to make up for this loss and to produce the desired quantity of a transmuted element (e.g. molybdenum-99).

TABLE 1

Molybdenum Neutron Isotopic Absorption Percentages

| Molybdenum Isotope | Energy 10 keV | Energy 1 keV | Isotopic Percentage | Absorption | Absorption Percentage |
|---|---|---|---|---|---|
| 92 | 0.12 b | 0.0003 b | 14.84% | 0.018 | 1.6% |
| 94 | 0.26 b | 0.007 b | 9.25% | 0.025 | 2.2% |
| 95 | 0.8 b | 1.8 b | 15.92% | 0.41 | 36.7% |
| 96 | 0.2 b | 0.006 b | 16.68% | 0.034 | 3.0% |
| 97 | 0.8 b | 2.0 b | 9.55% | 0.27 | 24.2% |
| 98 | 0.2 b | 1.1 b | 24.13% | 0.31 | 27.7% |
| 100 | 0.13 b | 0.4 b | 9.63% | 0.051 | 4.6% |

The present disclosure has described numerous configurations for the apparatus to produce the transmuted element as can be seen from the examples shown in FIGS. 1 to 4B. The outside shape of the apparatus can be spherical, cylindrical, cubic or any other possible shape. The neutron generators could produce neutrons using the deuterium-deuterium, deuterium-tritium, deuterium-boron, or other possible nuclear reactions. Each of these reactions can produce neutrons of different energies. The neutron generator may have a neutron multiplier at least partially surrounding the neutron generator, with a thickness sufficient to take advantage of high energy neutron multiplication by fission or the (n,2n) reaction. Also, the apparatus can contain additional moderator material such as carbon, lead, water, heavy water, beryllium, polyethylene, or other moderator materials. All of these different neutron energy outputs and moderator/multiplier materials can affect the rate at which the neutrons are absorbed in the element to be transmuted and can affect total quantity of neutrons absorbed by the element to be transmuted at a particular distance from the generator.

The Monte Carlo radiation transport computer code MCNPX (available from Los Alamos National Laboratory, Los Alamos, N. Mex.) was used to model neutron transport from various neutron generators and through various moderators into elements to be transmuted. An example of neutron transport from a neutron generator utilizing the deuterium-deuterium nuclear reaction, which produces approximately 2.45 MeV neutrons, into molybdenum dioxide, where molybdenum-98 is the element to be transmuted, is shown in Table 2. The number of neutron particles used for this particular example is $1\times10^8$ neutrons. The geometric configuration of the transmutation apparatus is that shown in FIGS. 4A and 4B. The radius of the neutron generator cavity is 15 centimeters and the outside radius of the molybdenum dioxide portion of the apparatus is 56 centimeters. No additional moderator materials or neutron multiplier materials were utilized for this example.

TABLE 2

Neutron Transport Through Molybdenum Dioxide

| Energy (MeV) | Fraction | Variance |
|---|---|---|
| 1.0000E−04 | 5.45478E−07 | 0.0097 |
| 3.4000E−04 | 1.18635E−07 | 0.0198 |
| 6.0000E−04 | 5.78914E−08 | 0.0268 |
| 1.0000E−03 | 5.24831E−08 | 0.0260 |
| 5.0000E−03 | 1.67474E−07 | 0.0213 |
| 1.0000E−02 | 7.67896E−08 | 0.0276 |
| 2.0000E−02 | 7.31534E−08 | 0.0275 |
| 3.0000E−02 | 4.25135E−08 | 0.0314 |
| 4.0000E−02 | 2.98903E−08 | 0.0342 |
| 5.0000E−02 | 2.38892E−08 | 0.0412 |
| 1.0000E−01 | 7.03752E−08 | 0.0299 |
| 5.0000E−01 | 1.32907E−07 | 0.0267 |
| 1.0000E+00 | 8.80206E−08 | 0.0271 |
| 1.5000E+00 | 4.37166E−08 | 0.0336 |
| 2.0000E+00 | 5.13923E−08 | 0.0264 |
| 2.5000E+00 | 3.99627E−07 | 0.0075 |
| 1.0000E+01 | 0.00000E+00 | 0.000 |
| 1.5000E+01 | 0.00000E+00 | 0.000 |
| Total | 1.97424E−06 | 0.0062 |

The first column of Table 2 is the energy bin for the neutrons. The second column lists the fraction of neutrons in a particular energy bin at the outside radius of the molybdenum dioxide. The unabsorbed, unmoderated fraction at the outside radius is approximately $2.5375\times10^{-5}$. The third column lists the statistical variance for the probability of neutrons being in a particular energy bin. With this example configuration, the MCNPX code calculated that approximately 91% of the 2.45 MeV neutrons leaving the neutron generator would be absorbed by the molybdenum. The aluminum structure of the apparatus and the oxygen absorbed an insignificant quantity of neutrons. The number of neutrons absorbed by molybdenum-98 for this example would be 27.7% of the 91% of the total output of the neutron generator. Thus, in this illustrative example, approximately 25% of the total neutrons produced by the generator are absorbed by the molybdenum-98.

In some implementations of the apparatus, the neutrons escaping the outside radius of the molybdenum dioxide can be absorbed by a thickness of neutron absorbing material (e.g., shielding) such as boron, borated polyethylene, cadmium, lithium, or other thickness of neutron absorbing material.

Examples of Methods for Transmuting Elements

Figure 5:
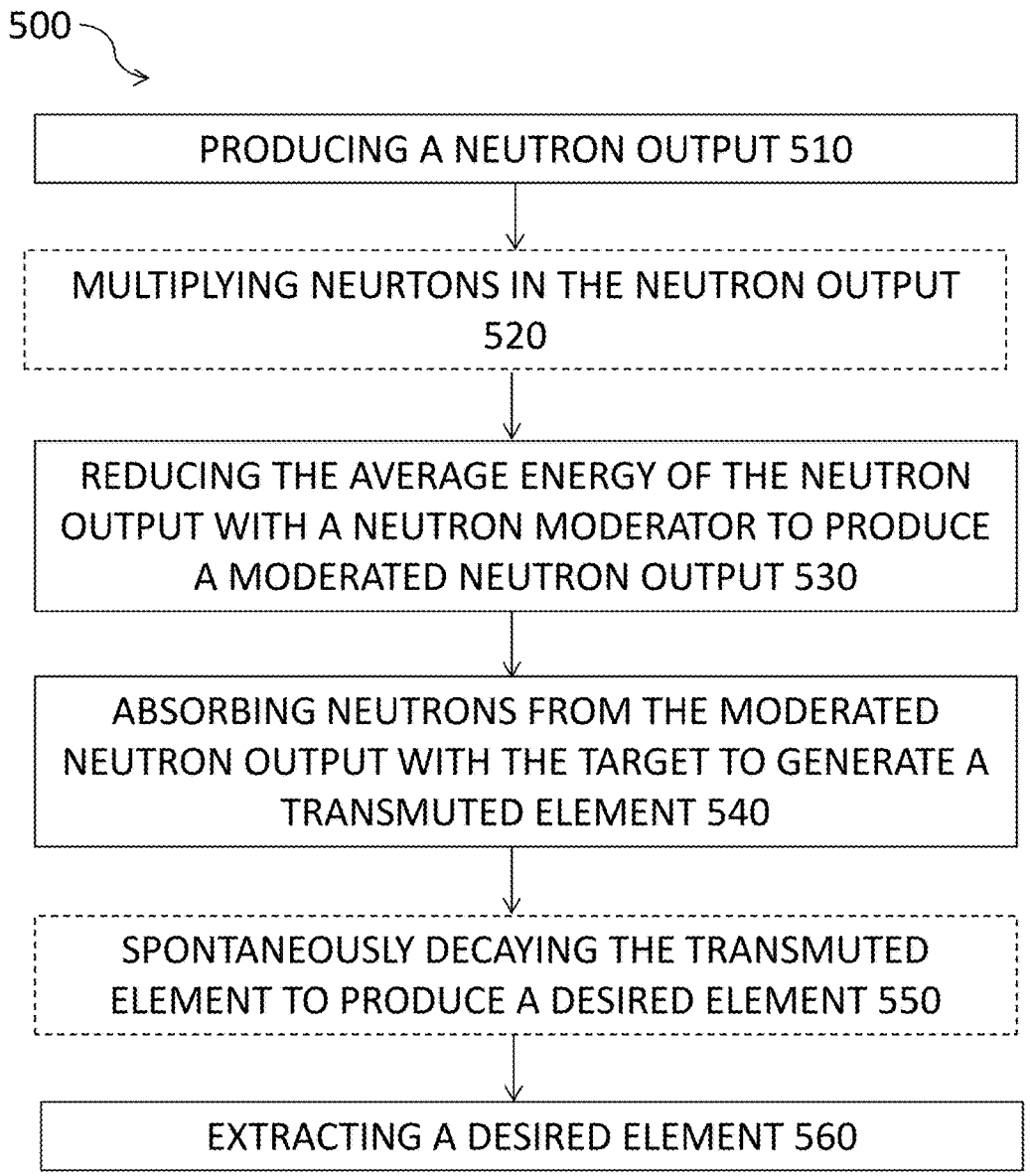
FIG. 5 is a flowchart for an example of a method for transmuting elements.

Some disclosed embodiments relate to methods of transmutating an element. FIG. 5 is a flowchart for an example of a method for transmuting elements. In some embodiments, a method 500 may include producing a neutron output 510, reducing an average energy of the neutron output with a neutron moderator to produce a moderated neutron output 530, absorbing neutrons from the moderated neutron output with the target to generate a transmuted element 540, and extracting a desired element 560. In some embodiments, the method further includes multiplying neutrons in the neutron output 520. Operation 520 may be optional. In some variations, the method may include operation 550, spontaneously decaying the transmuted element to produce a desired element; operation 550 may be optional. In some embodiments, the disclosed methods may be performed with the apparatus described herein.

In some embodiments, operation 510, producing a neutron output, may comprise operating a neutron generator as described in the disclosed apparatuses. The neutron generator may be operated to produce high energy neutrons. In some embodiments, the neutron generator may be operated for a period of time to allow a desired quantity of the desired element to be produced. In some embodiments, the neutron generator may produce neutrons which strike a neutron multiplier, thereby increasing the total quantity of neutrons. For example, neutrons may strike the nuclei of depleted uranium (acting as a neutron multiplier) surrounding the neutron moderator, creating more neutrons. Without being bound to a particular theory, high energy neutrons produced by the neutron generator that fail to create additional neutrons by fission or through (n,2n) or (n,3n) reactions may be moderated through elastic scattering in the depleted uranium before passing into the neutron moderator.

The neutrons produced by the neutron generator may be produced by any method known to those of skill in the art. For example, the neutrons can produced by accelerating with high voltage, in the range of about 50 kilovolts to about 250 kilovolts, ions of a light element, such as deuterium, into nuclei of an element or isotope such as deuterium, tritium, or boron-10. The deuterium-tritium reaction produces high energy neutrons with energies of about 14 MeV. These neutrons have sufficient energy to fission depleted uranium-238, thus producing several more neutrons for every incident neutron. The deuterium-tritium reaction cross section is higher than other cross section and thus produces more neutrons for a given amount of energy input into the accelerator. A further advantage of utilizing the deuterium-tritium reaction can be the production of additional fission neutrons when these 14 MeV neutrons strike uranium-238 nuclei.

To take advantage of this high reaction cross section and fission neutron production, both radioactive tritium and the heavy metal uranium would be utilized in such an apparatus, which may cause environmental concerns. To avoid (or reduce) the use of tritium and uranium in the apparatus and methods (e.g., to provide a "green" environmentally-friendly apparatus and methods), other reactions may be utilized, such as the deuterium-deuterium reaction producing neutrons or approximately 2.45 MeV and the deuterium-boron-10 reaction producing neutrons with energies between approximately 2 MeV and 8 MeV.

In some embodiments, operation 530, reducing an average energy of the neutron output with a neutron moderator to produce a moderated neutron output, may be employing a neutron moderator as described in the disclosed apparatuses. The energy of the moderated neutron output can range from less than the original energy of the neutron output to less than about 100 eV. The moderated neutron output may comprise neutrons that may then proceed out through a neutron multiplier or neutron moderator into the volume of the apparatus containing the target and that may also contain additional moderator material capable of moderating the neutron output or assisting in extraction of the desired element.

In some embodiments, operation 540, absorbing neutrons from the moderated neutron output with the target to generate a transmuted element, may be the nuclei of the target absorbing the neutrons from the moderated neutron output.

In some embodiments, once the desired quantity of the desired element is formed, the desired element may be extracted from the apparatus. In some embodiments, the desired element is extracted by using an extractor as described in the disclosed apparatuses. In some embodiments, operation 560, extracting a desired element, may include eluting a solution through the target to extract a desired element. Eluting a solution through the target to extract the desired element may comprise introducing an eluting solution into the apparatus and passing the eluting solution through the apparatus that may contain material that may assist in extraction, such as aluminum oxide. The eluting solution may retain the desired element and may exit the apparatus. The eluate may then be directed to a filter, vacuum evaporation apparatus, chromatography, settling means, etc.

Figure 7:
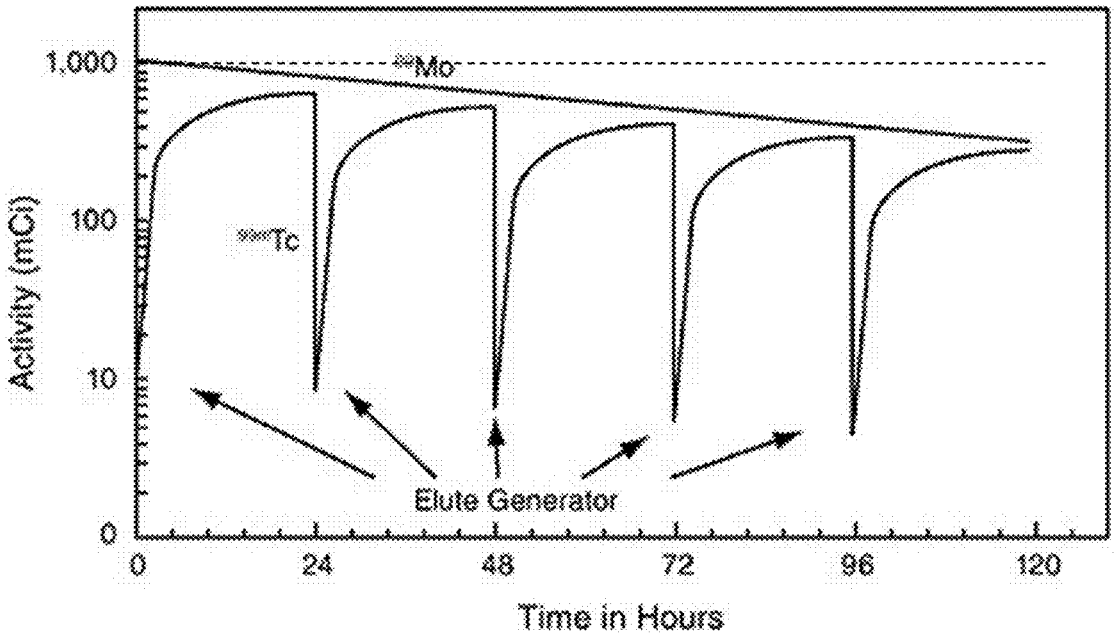
FIG. 7 is a graph of an example of activity (in mCi, with 1 Ci=$3.7\times10^{10}$ Bq (decays per second)) of Tc-99m as a function of time for various technetium generators.

FIG. 7 is a graph of an example of activity (in mCi, with 1 Curie (Ci)=$3.7\times10^{10}$ Bq (decays per second)) of Tc-99m and Mo-99 as a function of time for various technetium generators. The solid line denoted as "elute generator" depicts an example of Tc-99m as a function of time for a technetium generator that is eluted once every 24 hours. The overall activity decreases with time due to decay of the Mo-99 (shown as the straight line marked Mo-99 above the "elute generator" line) By comparison, the apparatus and methods disclosed herein may produce an activity of Tc-99m at a substantially constant level as shown by the dashed line. In this example, the activity can be approximately constant because the neutron generator can cause production of additional Mo-99 at rate that is approximately the same as the rate at which the Mo-99 decays.

Figure 8:
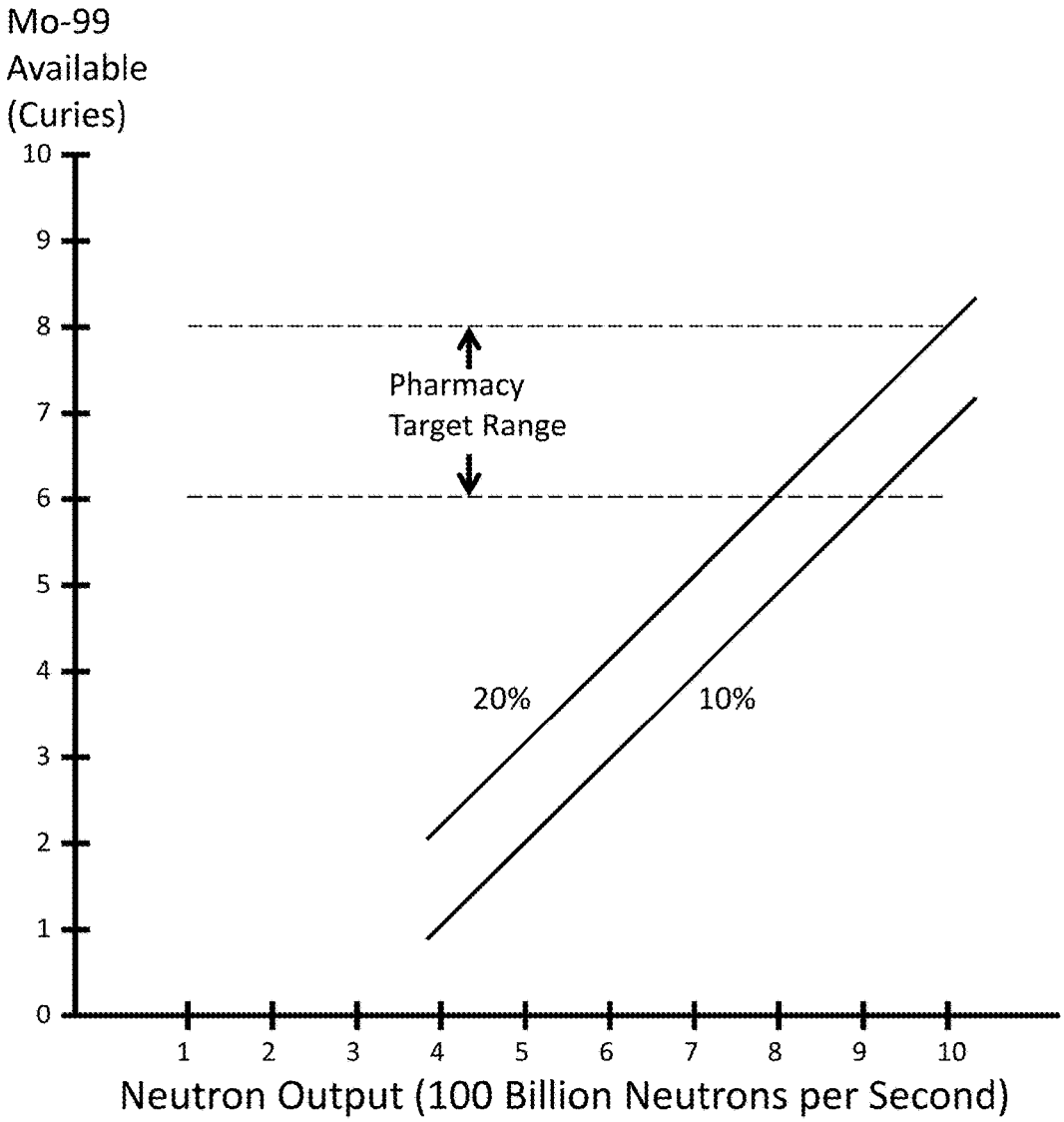
FIG. 8 is a graph of examples of the amount of Mo-99 (in Curies) as a function of the output of a neutron generator that can be produced in various implementations for 10% and 20% efficiency. An example of a target range for a medical imaging pharmacy is shown on the graph.

Various embodiments of the apparatuses and methods described herein may be used to produce ranges of about 1 and about 10 Curies of isotopic material in a 24 hour period or about 5 and 7 Curies of isotopic material in a 24 hour period. FIG. 8 is a graph of examples of the amount of Mo-99 (in Curies) as a function of the output of a neutron generator that can be produced in various implementations for 10% and 20% efficiency. An example of a target range for a medical imaging pharmacy is shown on the graph. In this illustrative, non-limiting example, if the efficiency is 20%, a neutron output in a range from about 800 to about 1000 billion neutrons per second may provide sufficient activity in Mo-99 to supply the medical imaging pharmacy. If the efficiency is about 10%, a greater neutron output from the neutron generator may be needed to supply the pharmacy (e.g., an output from about 900 to 1100 billion neutrons per second).

Example 1

The following example may be carried out using any of the disclosed apparatuses and methods.

A high output neutron generator located within the apparatus is surrounded by a thickness of depleted uranium as the neutron multiplier and neutron moderator. The main volume of the apparatus surrounding the neutron multiplier and neutron moderator is filled with a powder form of molybdenum dioxide and aluminum oxide. The neutron generator is then operated, producing high energy neutrons. These neutrons strike the nuclei of depleted uranium in the surrounding multiplier and neutron moderator, creating more neutrons. High energy neutrons produced by the neutron generator that fail to create additional neutrons by fission or through (n,2n) or (n,3n) reactions are moderated through elastic scattering in the depleted uranium before passing into the additional moderator material. The moderated or fission spectrum neutrons then proceed into the additional moderator material. The neutrons are further moderated by the molybdenum dioxide and aluminum oxide. As the neutrons are moderated to lower energies, the neutrons are absorbed by the nuclei of molybdenum, aluminum, and oxygen. As neutrons are absorbed by the isotope molybdenum-98, the isotope molybdenum-99 is produced. The molybdenum-99 isotope decays to technetium 99m. Saline is eluted through the apparatus to cause the formation of sodium pertechnetate. The soluble sodium pertechnetate elutes from the apparatus and may be collected by a filter to separate it from the bulk of the rest of the eluting solution. If a filter is not used, the sodium pertechnetate is separated from the bulk of water by evaporation, settling, or other means.

Various embodiments of the apparatuses and processes described herein may be used to produce ranges of about 1 and about 10 Curies of Tc-99m in a 24 hour period or about 5 and 7 Curies of Tc-99m in a 24 hour period.

Additional Examples and Embodiments

Some embodiments disclosed herein relate to an apparatus for the generation of technetium-99m from molybdenum-98. In such embodiments, the apparatus may comprise a neutron generator configured to emit neutrons with a neutron output, a neutron moderator having a diameter $D_1$ and configured to reduce an average energy of the neutron output to produce a moderated neutron output, one or more sections having a diameter $D_2$ and comprising molybdenum-containing material configured to absorb neutrons when exposed to the moderated neutron output, the absorption of the neutrons by the molybdenum-containing material producing molybdenum-99 from molybdenum-98, and an extractor configured to extract technetium-99m from the one or more sections.

In some embodiments, the neutron output may comprise neutrons produced at a rate of about $1\times10^{10}$ to about $1\times10^{15}$ neutrons per second. In some variations, the average energy of the neutron output may be about 2.4 MeV to about 14 MeV. The neutron moderator may substantially surround the neutron generator in some embodiments. In yet other embodiments, the neutron moderator may be lead, bismuth, tungsten, thorium, uranium, depleted uranium, water, deuterium oxide, beryllium, carbon, polyethylene, or combinations thereof.

In some embodiments, the diameter $D_1$ may be selected such that an energy of the moderated neutron output is in a range from about 1 keV to about 100 keV. In yet other embodiments, the molybdenum-containing material may be molybdenum oxide or powdered molybdenum. In some variations, the diameter $D_2$ may be selected such that the energy of the moderated neutron output is in a range from about 100 eV to about 1000 eV.

In some embodiments, the extractor may be a chromatography system, a vacuum filtration system, a centrifuge system, a vacuum evaporation system, gravity filtration system, or a combination thereof. In some variations, the apparatus may also include an eluting solution configured to be eluted through at least some of the one or more sections, wherein said eluting solution comprises water or saline.

Some embodiments disclosed herein related to an apparatus for transmutation of an element. The apparatus, in such embodiments, may comprise a neutron emitter configured to emit neutrons with a neutron output, a neutron moderator configured to reduce an average energy of the neutron output to produce a moderated neutron output, a target configured to absorb neutrons when exposed to the moderated neutron output, the absorption of the neutrons by the target producing a transmuted element, and an extractor configured to extract a desired element. In some embodiments, the neutron emitter may comprise a neutron generator. In some embodiments, the neutron output may comprise neutrons produced at a rate of about $1\times10^{10}$ to about $1\times10^{15}$ neutrons per second. In other variations, the average energy of the neutron output may be about 2.4 MeV to about 14 MeV. The neutron moderator may comprise lead, bismuth, tungsten, thorium, uranium, depleted uranium, water, deuterium oxide, beryllium, carbon, polyethylene, or combinations thereof.

In some embodiments, the thickness of the neutron moderator may be sufficient to reduce the energy of the neutron output to a level where a neutron capture cross-section of the target is above a first threshold. The target may comprise at least one of calcium, carbon, chromium, cobalt, erbium, fluorine, gallium, tritium, indium, iodine, iron, krypton, molybdenum, nitrogen, oxygen, phosphorus, rubidium, samarium, selenium, sodium, strontium, technetium, thallium, xenon, or yttrium.

In some variations, a thickness of the target may be sufficient to reduce the energy of the moderated neutron output to a level where a neutron capture cross-section of the target is above a second threshold, the second threshold above the first threshold, the second threshold preferably near a peak of the neutron capture cross-section of the target.

The apparatus may comprise an extractor. In such embodiments, the extractor may comprise a chromatography system, a vacuum filtration system, a centrifuge system, a vacuum evaporation system, gravity filtration system, or a combination thereof.

In some embodiments, the transmuted element may spontaneously decays to produce the desired element. The target may comprise molybdenum-98, the transmuted element may comprise molybdenum-99, and the desired element may comprise technetium-99m in some embodiments.

Some methods disclosed herein related to a method of transmutating a target. In some embodiments, the method may comprise producing a neutron output, reducing an average energy of the neutron output with a neutron moderator to produce a moderated neutron output, absorbing neutrons from the moderated neutron output with the target to generate a transmuted element, and extracting a desired element. In some embodiments, the method may also comprise multiplying neutrons in the neutron output. In yet other embodiments, the method may also comprise spontaneously decaying the transmuted element to produce a desired element.

In some embodiments, the thickness of the neutron moderator may be sufficient to reduce the energy of the neutron output to a level where the neutron capture cross-section of the target is above a first threshold. In some embodiments, the thickness of the target may be sufficient to reduce the energy of the moderated neutron output to a level where the neutron capture cross-section of the target is above a second threshold, the second threshold above the first threshold, the second threshold preferably near a peak of the neutron capture cross-section of the target.

CONCLUSION

Although certain examples herein have been described in the context of production of Mo-99 for generation of Tc-99m, the apparatus and methods described herein can also be implemented for neutron transmutation of other elements or isotopes. For example, the apparatus and methods can be used for transmuting elements or isotopes including calcium, carbon, chromium, cobalt, erbium, fluorine, gallium, tritium, indium, iodine, iron, krypton, molybdenum, nitrogen, oxygen, phosphorus, rubidium, samarium, selenium, sodium, strontium, technetium, thallium, xenon, yttrium, or any other element capable of producing an element or isotope by neutron transmutation.

Various numerical examples, tables, graphs, and data are presented herein. These numerical examples, tables, graphs, and data are intended to illustrate certain example embodiments and not intended to limit the scope of the disclosed apparatus and methods.

The various features, apparatus, and processes described above may be used independently of one another, or may be combined in various ways. All possible combinations and subcombinations are intended to fall within the scope of this disclosure. In addition, certain method or process blocks may be omitted in some implementations. The methods and processes described herein are also not limited to any particular sequence or order, and the blocks or operations relating thereto can be performed in other sequences or orders that are appropriate. For example, described blocks or operations may be performed in an order other than that specifically disclosed, or multiple blocks or operations may be combined in a single block or operation. The example blocks or operations may be performed in serial, in parallel, or in some other manner. Blocks or operations may be added to, removed from, or rearranged compared to the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require at least one of X, at least one of Y and at least one of Z to each be present.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions and changes in the form of the methods and systems described herein may be made without departing from the spirit of the inventions disclosed herein. The accompanying claims and their equivalents are intended to cover such forms or modifications as would fall within the scope and spirit of certain of the inventions disclosed herein.

What is claimed is:

1. An apparatus for the generation of technetium-99m from molybdenum-98, the apparatus comprising:

a neutron generator configured to emit neutrons with a neutron output;

a neutron moderator having a diameter $D_1$ and configured to reduce an average energy of the neutron output to produce a moderated neutron output, the neutron moderator comprising a neutron multiplier to increase the number of neutrons in the neutron output, the neutron moderator comprising lead;

a plurality of sections having a diameter $D_2$ and comprising molybdenum-containing material configured to absorb neutrons when exposed to the moderated and multiplied neutron output, the molybdenum-containing material comprising powdered molybdenum dioxide, the absorption of the neutrons by the molybdenum-containing material producing molybdenum-99 from molybdenum-98;

a manifold configured to flow an eluting solution comprising saline through the powdered molybdenum dioxide in each of the plurality of sections; and an extractor configured to receive the eluting solution after flowing through each of the plurality of sections and to extract technetium-99m.

2. The apparatus of claim 1, wherein the neutron output comprises neutrons produced at a rate of about $1\times10^{10}$ to about $1\times10^{15}$ neutrons per second.

3. The apparatus of claim 1, wherein the average energy of the neutron output is about 2.4 MeV to about 14 MeV.

4. The apparatus of claim 1, wherein the neutron moderator substantially surrounds the neutron generator.

5. The apparatus of claim 1, wherein the diameter $D_1$ is selected such that an energy of the moderated neutron output is in a range from about 1 keV to about 100 keV.

6. The apparatus of claim 1, wherein the diameter $D_2$ is selected such that the energy of the moderated neutron output is in a range from about 100 eV to about 1000 eV.

7. The apparatus of claim 1, wherein the extractor further comprises a chromatography system, a vacuum filtration system, a centrifuge system, a vacuum evaporation system, gravity filtration system, or a combination thereof.

8. An apparatus for transmutation of molybdenum-98, the apparatus comprising:

a neutron emitter configured to emit neutrons with a neutron output, wherein the neutron output comprises neutrons produced at a rate of about $1\times10^{10}$ to about $1\times10^{15}$ neutrons per second;

a neutron moderator configured to reduce an average energy of the neutron output to produce a moderated neutron output;

molybdenum-containing material configured to absorb neutrons when exposed to the moderated neutron output, the absorption of the neutrons by the molybdenum-containing material producing molybdenum-99 from molybdenum-98, the molybdenum-containing material comprising powered molybdenum dioxide; and an extractor configured to extract technetium-99m;

wherein a leak neutron capture cross-section of the molybdenum-containing material is at about 300 to about 500 eV, a thickness of the neutron moderator is sufficient to reduce the energy of the neutron output to a level where a neutron capture cross-section of the molybdenum-containing material is above a first threshold of greater than about 1% of the peak cross-section, and a thickness of the molybdenum-containing material is sufficient to reduce the energy of the moderated neutron output to a level where the neutron capture cross-section of the molybdenum-containing material is above a second threshold, the second threshold above the first threshold, the second threshold near the peak cross-section.

9. The apparatus of claim 8, wherein the neutron emitter comprises a neutron generator.

10. The apparatus of claim 8, wherein the average energy of the neutron output is about 2.4 MeV to about 14 MeV.

11. The apparatus of claim 8, wherein the neutron moderator comprises lead, bismuth, tungsten, thorium, uranium, depleted uranium, water, deuterium oxide, beryllium, carbon, polyethylene, or combinations thereof.

12. The apparatus of claim 8, wherein the extractor comprises a chromatography system, a vacuum filtration system, a centrifuge system, a vacuum evaporation system, gravity filtration system, or a combination thereof.

13. The apparatus of claim 8, wherein transmuted molybdenum-99 spontaneously decays to produce the desired technetium-99m.

14. The apparatus of claim 1, wherein the plurality of sections comprises aluminum.

* * * * *